United States Patent [19]

Ilmarinen et al.

[11] Patent Number: 4,919,759

[45] **Date of Patent: * Apr. 24, 1990**

[54] CONTROL OF DETACHMENT OF A PAPER WEB FROM A ROLL USING HEAT

[75] Inventors: Antti Ilmarinen; Veijo Miihkinen, both of Jyväskylä ; Jorma Laapotti, Palokka, all of Finland

[73] Assignee: Valmet Paper Machinery Inc., Finland

[ * ] Notice: The portion of the term of this patent subsequent to Dec. 26, 2006 has been disclaimed.

[21] Appl. No.: 147,457

[22] Filed: Jan. 25, 1988

[30] Foreign Application Priority Data

Jan. 23, 1987 [FI] Finland ..... 870308

[51] Int. Cl.[5] ..... D21F 3/02

[52] U.S. Cl. ..... 162/206; 162/207; 162/359; 162/360.1; 100/38; 219/10.492

[58] Field of Search ..... 162/305, 359, 360.1, 162/198, 199, 206, 207; 100/38, 93 RP; 34/116, 117, 120, 41; 219/10.492, 10.61 A

[56] References Cited

U.S. PATENT DOCUMENTS

| | | | |
|---|---|---|---|
| 4,351,700 | 9/1982 | Dove | 162/359 |
| 4,525,241 | 6/1985 | Laapotti | 162/360.1 |
| 4,691,449 | 9/1987 | Wiberg | 162/359 |
| 4,738,752 | 4/1988 | Busker et al. | 162/359 |

FOREIGN PATENT DOCUMENTS

| | | | |
|---|---|---|---|
| 43289 | 1/1982 | European Pat. Off. | 162/206 |

*Primary Examiner*—Karen M. Hastings

*Attorney, Agent, or Firm*—Steinberg & Raskin

[57] ABSTRACT

Control of detachment of a web from a roll, such as a paper web from a press roll in a paper machine, in particular a so-called closed press section provided with a smooth-faced press roll. The temperature of the surface of the smooth-faced press roll is adjusted, so that adhesion between the roll surface and the paper web to be detached is influenced or affected. Thereby, the detaching angle and/or the detaching tension of the paper web, is set within an optimal range. Temperature profile of the smooth-faced press roll in the axial direction thereof, can also be adjusted with a view to controlling the detaching of the web.

23 Claims, 3 Drawing Sheets

CONTROL OF DETACHMENT OF A PAPER WEB FROM A ROLL USING HEAT

BACKGROUND OF THE INVENTION

The present invention concerns a method in a press section of a paper machine, in particular in a so-called closed press section provided with a smooth-surfaced press roll, for the control of detaching of the paper web from the press roll.

The present invention further concerns a device in a press section of a paper machine, the press section including a smooth-surfaced press roll, preferably a central roll, with a web being detached from the smooth surface thereof, and preferably passed as an open draw to a drying section of the paper machine.

So-called closed press sections are commonly used in a paper macine, wherein one press nip is formed or generally several press nips are formed in connection with the central roll. An example of a prior-art press section is a press section marketed by the assignee under the trademark "SYM-PRESS II", where a smooth-faced central roll having a larger diameter than diameters of other press rolls, is usually made of rock, as a rule of granite. Since granite is an unhomogeneous natural material of low tensile strength, it is quite questionable in machine construction. For example, if a granite roll is desirably heated, the deformations thereof which are dependent upon temperature, are non-linear and difficult to predict.

As press roll material, granite has relatively good properties of adhesion, transfer, and detaching of the web, which are several of the reasons for its repute. However, the detaching properties could be better, especially with regard to unbleached paper qualities.

In a manner known in the prior art, the web is detached as an open, unsupported draw from the face of the central roll in the press. This open draw is quite critical in view of the operation of the paper machine. In the open draw, a difference in speed is used which extends the web, resulting in certain drawbacks. Moreover, the open draw forms a questionable point, susceptible to breaks in a paper machine.

Prior art technology has not provided efficient means for controlling the open draw of a web which occurs from a smooth-surfaced central roll. The unfavorable properties of granite have, for their part, make control of the open draw more difficult.

The open draw of the web has become an increasingly difficult point, with continuously increasing running speeds of a paper machine. Since different paper qualities are often manufactured by way of a single paper machine, with adhesion to the surface of a rock roll being different for different paper qualities, variations in detaching tension required for a web result.

SUMMARY OF THE INVENTION

Accordingly, it is an object of the present invention to provide a new and improved manner for detaching a web from a central roll in a press section, and transferring the web to a drying section.

It is also an object of the present invention to provide a new and improved regulating system in which detaching of a paper web from a smooth surface of a central roll in a press section, can be controlled better than in the prior art.

It is an additional object of the present invention to provide a system of regulating detaching of a web from the smooth surface of a central roll, of the type noted above, in which the tension of detaching of the web can be optimally set irrespective of dry solids content of the paper web, of surface energy of the substance, and of running speeds of the paper machine.

These and other objects are attained by the present invention which is directed to a method for detaching a web from a roll, comprising the steps of adjusting temperature of a surface of the roll, whereby adhesion between the web and the roll surface is affected, and thereby setting at least one of a detaching angle of the web off the roll and detaching tension of the web within an optimal range. The roll is preferably a smooth-surfaced press roll, more preferably a central roll in a closed press section of a paper machine.

The present invention is also directed to a device for detaching the web from a roll, which comprises means for adjusting temperature of a surface of the roll, and thereby controlling detachment of the web off the roll surface. The temperature adjusting means may comprise at least one heating device for applying heat to the roll surface. As noted above, the roll may preferably be a smooth-surfaced press roll, more preferably a central roll in a press section of a paper machine. The web is preferably passed from the central roll as an open draw to a drying section of the paper machine.

With a view to achieving the objects noted above and those which will become apparent below, the method of the present invention is principally characterized by the temperature of the face or surface of a smooth-surfaced press roll being adjusted, and adhesion between the roll face or surface and the paper web to be detached being influenced or affected by way of this adjusting. Thereby, the detaching angle and/or detaching tension of the paper web, are/is set within an optimal range.

Furthermore, a device in accordance with the present invention is principally characterized by heating devices being provided in connection with the smooth-surfaced press roll, by means of which temperature of the smooth face of the press roll, and thereby detaching of the web from the roll, are affected or influenced.

The present invention is based on the conept that temperature at an interface between a paper web and a smooth roll surface from which the web is being detached, affects dry solids content of the web, the surface energies of the materials in contact with one another, and viscosity of water. These parameters, in turn, affect or influence adhesion between the paper web with the water contained therein, and the smooth roll face. By establishing inter-dependencies of these parameters, by controlling the same, and by adjusting temperature of the roll surface based on this information by means of a regulating system in accordance with the present invention, it is now possible to set detaching tension of the paper web at a suitable level, even within highly varying operating conditions. Thus, with the present invention, it is possible to adjust temperature of the smooth face of the roll to a certain set value, which provides optimal detaching of the web and running quality when running different paper qualities and with different running speeds of the paper machine, with the web quality and machine speed that are used at each particular time.

In the present invention, the central roll of the press or any other corresponding smooth-faced roll from which the paper web is intended to be detached, may be a substantially metal-mantle roll coated with a metal or with a ceramic material, or with mixtures of these. This roll may be a cast-iron roll or an uncoated roll. In particular, the roll is arranged to be heated by means ofadjustable heating devices. Such heating may take place from inside and/or outside the roll, partially by way of previously known techniques.

The present invention is in no way restricted for use for detecting a web from a central roll of a closed press section of a paper machine alone. Rather, the present invention is well-suited and intended for controlling the detaching of a web from a smooth-faced roll in a press in general, i.e. also from a roll other than a central roll.

The regulating system of the present invention may be provided with a feedback, wherein behavior of a web in the detaching draw is monitored either visually by means of optical detectors, or by means of detectors that sense location. In this feedback, it is possible to use for providing a measurement signal or adjustment signal, difference in speed of the web between a drying group and the press, or a separate measurement roll by means of which web tension can be measured.

In a preferred embodiment of the present invention, temperature profile of the smooth face of the central roll or equivalent is provided to be adjustable over an axial direction of the roll. By way of this procedure, it is possible to optimally set distribution of detaching tension in a transverse direction of the web, and to prevent formation of curving in the detaching line in lateral areas of the web, and thereby prevent breaks in the web which usually begin in these lateral areas.

The advantages of the present invention are manifested with special emphasis on thin paper qualities, with which it is possible to reduce the number of web breaks taking place in an open draw to a substantial extent by way of the invention herein.

In certain cases, it is possible to shorten the open draw or to even introduce a practically closed draw from the press section to the drying section, due to the present invention.

The temperature of the roll face is preferably adjusted within the range of about 30° C.–150° C., preferably within the range of about 50° C.–100° C.

BRIEF DESCRIPTION OF THE DRAWINGS

Background of the present invention and certain of the exemplifying embodiments of the invention herein will be described in greater detail below, with reference to illustrations in the accompanying drawings, in which.

DESCRIPTION OF THE PREFERRED EMBODIMENTS

Figure 1:
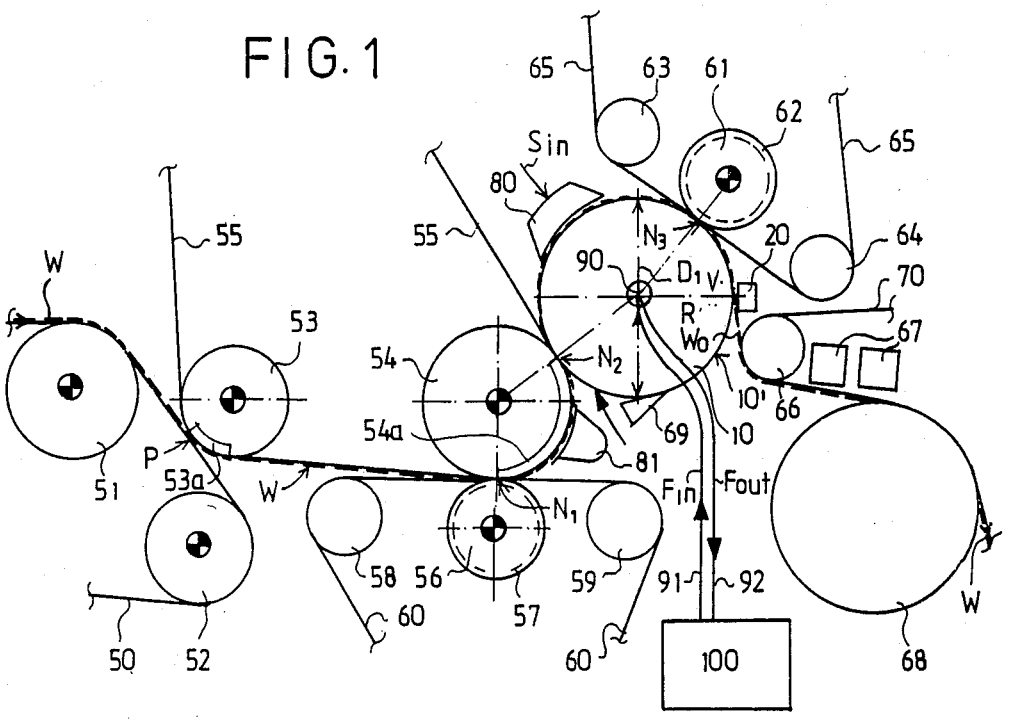
FIG. 1 is a schematic view of a closed press section, utilizing devices and the method of the present invention.

FIG. 1 is a schematic side view of a "SYM-PRESS II" press section of the assignee, in which a control system in accordance with the present invention has been applied. Overall construction of the press section illustrated in FIG. 1 will first be described as background.

A paper web W is drained upon a forming wire 50 of a paper machine, from which the web W is detached on a downwardly inclined run of the wire 50 between wire suction roll 51 and wire drive roll 52 at a detaching point P, and transferred within a suction zone 53*a* of a pick-up roll 53 onto a pick-up felt 55. The web W is transferred on a lower face of the pick-up felt 55 into a first dewatering press nip $N_1$.

The first nip $N_1$ is formed between a press-suction roll 54 and a hollow-faced 57 lower press roll 56. Two felts run through the nip $N_1$, i.e. a lower felt 60 guide by guide rolls 58 and 59, and the pick-up felt 55 which acts as an upper felt in the first press nip $N_1$. After the first nip $N_1$, the web W follows along with the upper roll 54 by effect of the suction zone 54*a* of the press-suction roll 54, and moves into a second dewatering press nip $N_2$ which is formed between the press suction roll 54 and a smooth-faced 10' central roll 10. A diameter $D_1$ of the central roll 10 is substantially larger than diameters of the other press rolls 54, 56, and 61. Therefore, there is space for various apparatus to be fitted around the central roll 10, including heating apparatus 20, 80, 100 applied in accordance with the present invention. A steam box 81 is situated within the suction section 54*a* of the suction roll 54 as illustrated, this steam box 81 acting upon an outer face of the web W and raising temperature of the web W and of the water contained therein, thereby lowering viscosity of the water.

A third dewatering press nip $N_3$ is situated substantially at the opposite side of the central roll 10 relative to the second nip $N_2$. A press felt 65 runs through the third dewatering press nip $N_3$ and is guided by guide rolls 63 and 64. The central roll 10 and a hollow-faced 62 press roll 61 form the third nip $N_3$.

Adhesion properties of the smooth face 10' of the central roll 10 are such that, after the second nip $N_2$, the web follows along with the face 10' of the central roll 10. There is a doctor 69 on a lower free sector of the central roll 10, which keeps the roll face 10' clean and detaches from the roll face 10', paper web which is understood as becoming broke. From the face 10' of the central roll 10, the web is detached at the detaching point R as an open draw $W_0$ and transferred onto a drying wire 70, the loop thereof having been situated at a distance as short as possible from the face 10' of the roll 10, and being guided by a guide roll 66. After the guide roll 66, suction boxes 67 are situated inside the loop of the drying wire 70, ensuring that the web W adheres to the drying wire 70 and reliably passes to the drying section, with reference numeral 68 denoting the first drying cylinder or a corresponding lead-in cylinder thereof.

Figure 2:
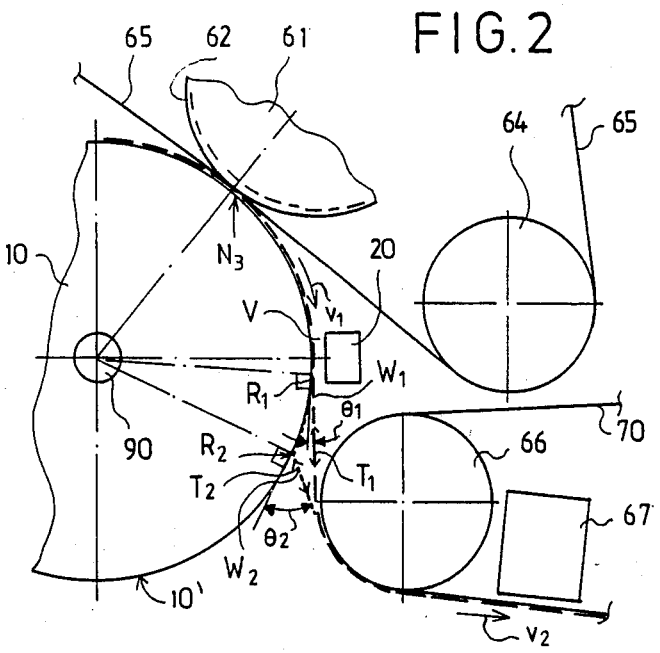
FIG. 2 illustrates a rear end of the press section in greater detail, showing geometry of the open draw of the web, as well as various parameters of the same.

Detaching of the web W from the smooth-face 10' of the central roll 10 and transfer as an open draw $W_1$ of $W_2$ onto the drying wire 70, will be described below with reference to FIG. 2. In FIG. 2, the detaching angle of the draw $W_1$ is denoted by the symbol $\theta_1$, with the corresponding detaching point being denoted by $R_1$. The detaching angle of the second draw $W_2$ is denoted by the symbol $\theta_2$, with the detaching point thereof being denoted by $R_2$. Detaching tensions of the open draws $W_1$ and $W_2$ are denoted by $T_1$ and $T_2$ respectively.

It has been generally ascertained that the smaller the detaching angle $\theta$, the greater the detaching tension T that is required. Also, the detaching tension T is determined by difference between the speed $v_2$ of the drying wire 70 and the speed $v_1$ of the face 10' of the central roll 10, i.e. by a so-called difference in draw $\Delta v = v_2 - v_1$ ($v_1$ = web speed in the press section before detaching, $v_2$ = web speed at the beginning of the drying section). As a rule, $\Delta v/v_1$ is in the range of $\Delta v/v_1$ = about 1%–3%. The web tension, i.e. detaching tension T, can be calculated as follows:

$$T = \frac{W_E + W_S}{1 - \cos\theta} + (1 + \epsilon)\, mv^2 \quad (1)$$

$$W_S = 8.42\left(\mu v/\left(\frac{\mu v}{\sigma}\right)\right)^{0.95} \quad (2)$$

wherein:
T = web tension
$\theta$ = detaching angle
$W_E$ = web elongation work
$W_S$ = detaching work
$\epsilon$ = elongation
m = mass
v = speed
$\mu$ = viscosity
$\sigma$ = surface energy The following fundamental circumstances concerning the present invention result from the above formulas (1) and (2). When temperature at the contact point between the web W and the roll face 10' rises, detaching tension T becomes lower because the viscosity $\mu$ is reduced and the surface energy $\sigma$ is also reduced. Therefore, detaching work $W_S$ (formula 2) is resultingly reduced with the dry solids content being increased (due to this last-noted feature, the term $mv^2$ becomes lower).

Figure 3:
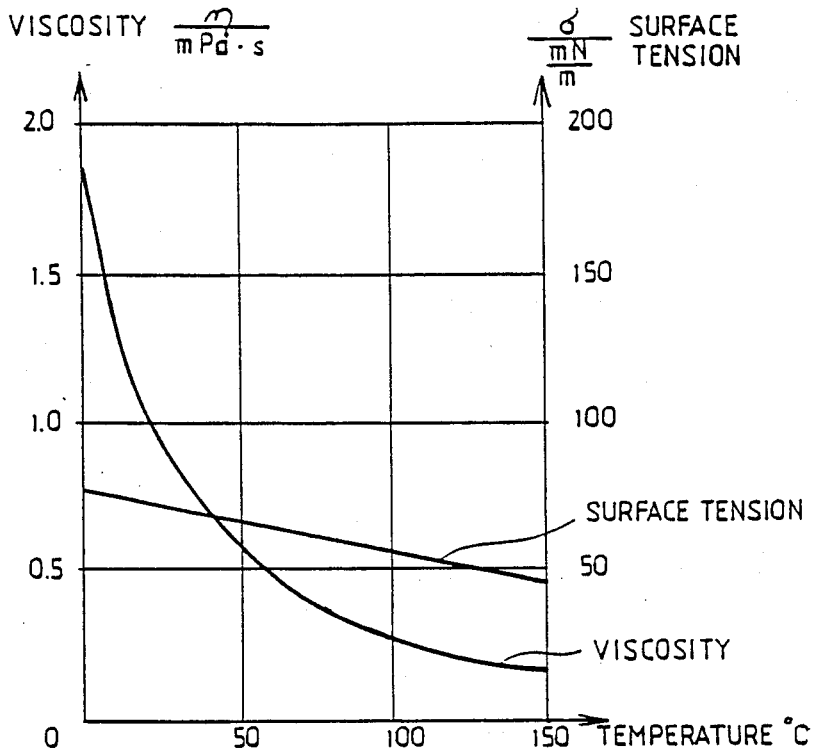
FIG. 3 is a graph illustrating the dependence of viscosity and surface tension of water, upon temperature.

FIG. 3 illustrates dependence of viscosity and surface tension of water upon temperature. As seen, surface tension is lowered in a substantially linear fashion as temperature is raised, while viscosity is lowered very steeply within a temperature range of about 0° C. to 80° C., and the substantially in the same proportion as the surface tension is lowered with rising temperature.

It can be concluded from FIG. 3 and also from the above-noted formulas (1) and (2), that with rising temperature of the roll 10', the web tension T required to detach the web W from the roll 10' is lowered, i.e. the web W is detached from the roll face 10' more readily at higher temperatures. As noted above, a reduced web tension T results in an increased detaching angle $\theta$.

The central roll that is used in the present invention is generally a roll with a metallic mantle, preferably a roll of ferro-magnetic material, i.e. material that is preferred over rock material with respect to both construction and operation.

In the present invention, active use has been made of the usually inverse interdependence between the web tension T and the temperature of the roll face 10', which was described above. For this purpose, as is shown in FIG. 1, a steam box 80 is fitted in connection with the faces 10' of the central roll 10 between the nips $N_2$ and $N_3$. The temperature of the web W and the temperature and viscosity of the water contained in the web are influenced or affected by means of the steam $S_{in}$ passed into the steam box 80, with the temperature of the surface 10' of the roll 10 also being indirectly affected.

As shown in FIG. 1, inductive heating apparatus 20 are situated before the detaching point R and substantially in a horizontal plane passing through a center of rotation of the central roll 10. The heating apparatus 20 act, free of contact, through an air gap V, substantially upon temperature of a thin surface layer of the web face 10'.

As also shown in FIG. 1, a heating medium $F_{in}$ in fed into the roll 10 through a pipe 91 and a connection 90, this medium being removed out of the roll ($F_{out}$) through the same connection 90 or through another connection (not illustrated) situated in conjunction with the opposite end of the roll shaft, and a pipe 92. The apparatus for the circulation and heating of the heating medium are schematically denoted by block 100 in FIG. 1.

Even though three different sets of equipment 20; 80; 100 are shown in FIG. 1 for heating of the face 10' of the central roll and of the web W, with a view to controlling draw tension T, $T_1$, $T_2$ of the open draw $W_o$, $W_1$, $W_2$ (in other words, the steam box 80, the inductive heating apparatus 20, and devices 90, 91, 92 and 100 for heating and circulation of the heating medium within the roll), as a rule all of the apparatus or devices do not have to be used at the same time in a single practical application.

As preliminarily stated above, when the method of the present invention is being applied, a granite roll or any other rock roll is not used as a central roll in the press or as any other corresponding smooth-faced roll. Rather, a metal-mantle roll coated with a metal or with a ceramic substance or with a mixture of these, a cast-iron roll, ir an uncoated metal roll is used, this type of roll being constructively preferable to a rock roll of natural material. The face 10' of a metal roll or equivalent can be heated to an optimal temperature in accordance with the present invention, without uncontrolled phenomena of alteration.

A synthetic press roll described in Finnish patent applications Nos. 853544 and 854748 of the assignee may be favorably used in conjunction with the present invention. Surface energies of such rolls can be appropriately chosen from the point of view of the present invention, considering adhesion between the web W and the roll face 10' and the detaching process itself.

Instead of or in addition to the steam box 80 described above, it is possible to use a radiation heater, e.g. an infrared heater, the construction thereof being known in and of itself. An exemplary embodiment of such a heater is illustrated, e.g., in Finnish patent application No. 861086 of the assignee, where it is applied in conjunction with an airborne web dryer.

In addition to heating taking place by means of a heating medium circulating ($F_{in}$–$F_{out}$) in the roll 10 as shown in FIG. 1, it is possible to use electric heating apparatus such as resistance heating or inductive heating. An example of heating apparatus fitted inside the roll as suitable for use in conjunction with the present invention, is described in Finnish patent No. 69,151 to the assignee, where distribution of temperature over the axial direction of the roll 10 can also be controlled by means of the apparatus described therein.

It is possible to use a steam box 80, and/or infrared heating, and/or inductive heating of the central roll before the last nip $N_3$. For internal heating of the central roll 10, it is possible to use a circulating medium such as steam or water, and/or electric heating such as inductive heating or resistive heating. Within the area of the detaching point R of the web W, it is possible to use either infrared heating and/or an inductive heating apparatus 20, as adjustable heating apparatus for the roll 10.

Figure 4:
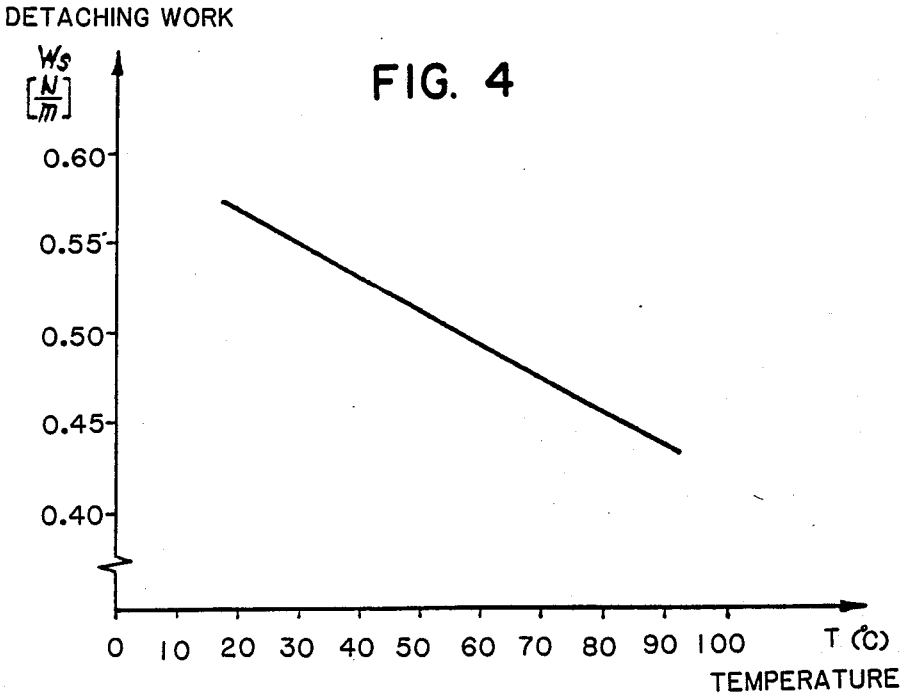
FIG. 4 is a graphical presentation detaching work of a web from a smooth-faced roll as a function of temperature.

FIG. 4, shows the effect of temperature of the interface or contact point between the paper web W and the roll 10 upon detaching. The vertical axis of the graph of FIG. 4 represent the detaching work $W_S$ (N/m) and the horizontal axis represents the temperature at the contact point between the web W and the roll 10. The graphic representation in FIG. 4 has been obtained by calculating from formula (2) the detaching work $W_S$ at different temperatures while the speed of the web W is 20 m/s, and using the viscosity and surface energy (=surface tension) values obtained from the curves of FIG. 3. It may be seen from FIG. 4, that the detaching work $W_S$ of the web is reduced with increasing temperature of the contact point between the web W and the roll 10. While the detaching work $W_S$ diminishes with increasing temperature, the detaching tension T is also reduced at the same time (FIG. 3).

The inductive apparatus 20 will be described below with reference to FIGS. 5 and 6 which presently represent the most advantageous embodiments of the present invention, both with respect to efficiency and with respect to possibility of adjusting transverse profile of the control and heating effect.

Figure 5:
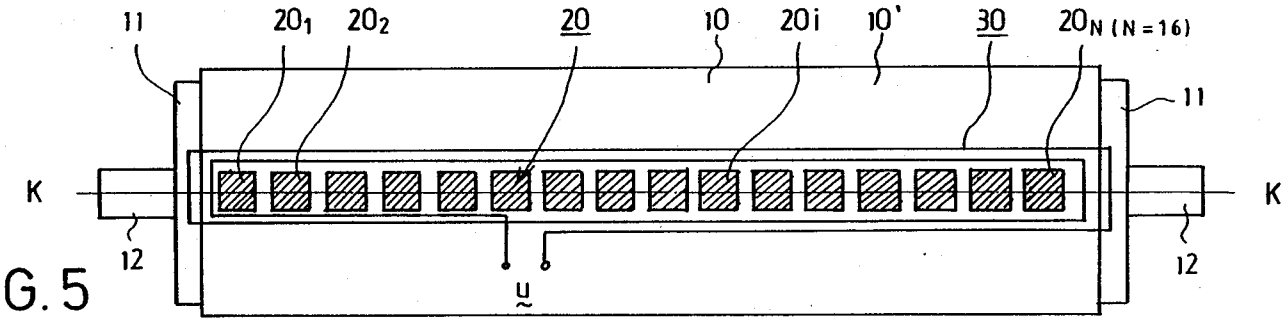
FIG. 5 is a schematic illustration as seen in a machine direction of the principles of an induction heating apparatus suitable for application in accordance with the present invention.

The smooth-faced 10' press roll 10 illustrated in FIG. 5, is the roll from the which the web W is detached. The roll 10 has a smooth and hard face 10', and has a cylindrical mantle which is made of suitable ferromagnetic material and which has been chosen with consideration of the strength properties of the roll and of the inductive and electromagnetic heating in accordance with the present invention. The roll 10 is rotatably mounted around a central axis K—K through ends 11 thereof and axle journals 12 as illustrated. Bearings are fitted in bearing housings on the axle journals 12. The bearing housings are attached to a supporting frame of the roll, which, in turn, is situated on a base.

It is possible to fit crown-variation or crown-adjustment devices known in and of themselves, in an interior of the roll 10, in which there is plenty of room due to the present invention because it is not necessary to use in an interior of the roll 10, heating apparatus operating with a liquid medium or other corresponding heating apparatus. However, such heating apparatus are not excluded, and may certainly be used in conjunction with the present invention herein (please see, e.g. system 100, 91, 90, 92, $F_{in}$ and $F_{out}$ in FIG. 1).

The roll 10 is arranged to be inductively and electromagnetically heatable by means of eddy currents so that temperature of the face 10' of the roll 10 is raised by way of this heating to a considerably high level, generally to about 70° C. to 100° C. With a view to accomplishing this inductive heating, component cores $20_1$, $20_2$ . . . $20_N$ of an iron core are arranged in a proximity of the roll 10 in the same horizontal line with one another over an axial direction of the roll. These component cores $20_N$ form a magnetic-shoe apparatus 20, which further includes a common excitation winding 30, or an individual winding about each component core 20 (not illustrated).

The inductive heating is carried out free of contact, so that a small air gap V remains between the iron core 20 and the roll 10 face 10'. Magnetic fluxes of the iron core are closed or concentrated through the nip gap V, via the roll mantle 10, thereby causing a heating effect in the same.

Figure 6:
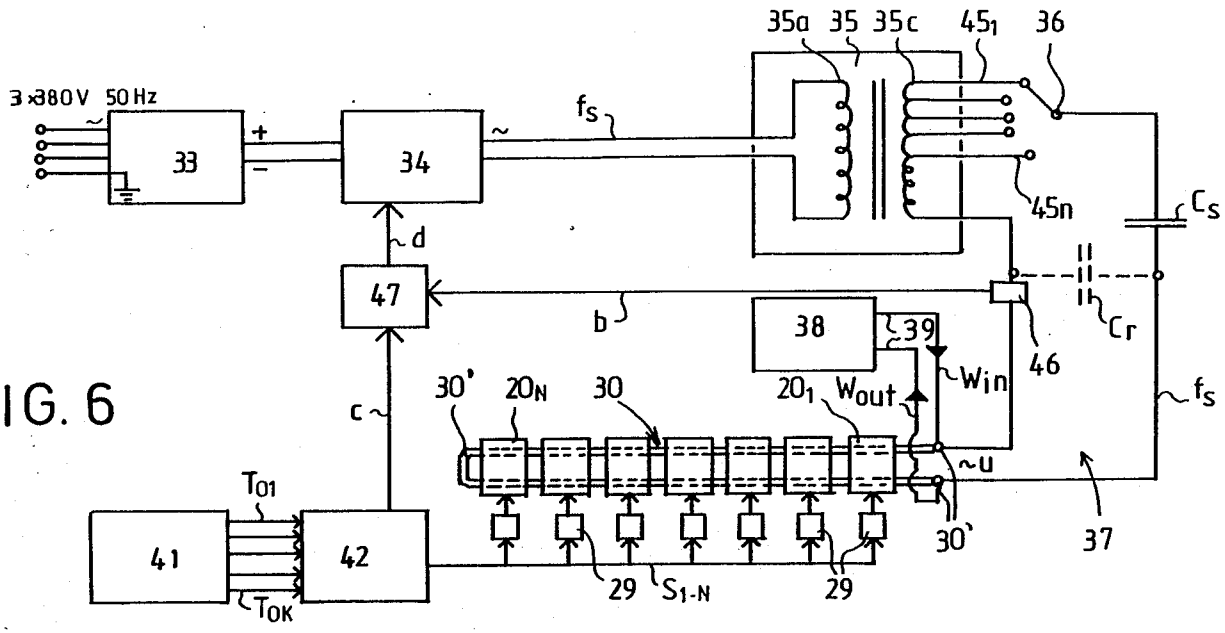
FIG. 6 is a block diagram illustrating an exemplary embodiment of an induction heating apparatus in accordance with the present invention.

According to FIGS. 5 and 6, all of the component cores $20_1$ . . . $20_N$ (N=16) have a common excitation winding 30, wherein there are two turns in FIG. 5, and only one turn in FIG. 6.

Each component core $20_N$ is arranged to be separately displaceable in a radial plane of the roll 10, so that magnitude of the active air gap V can be adjusted and, at the same time, the heating capacity can also be controlled. For this purpose, each component core is attached to the frame by means of an articulated joint. Displacement of the component cores $20_N$ can be arranged by way of various mechanisms. As a rule, the air gaps V may vary, e.g., within the range of about 1 to 100 mm. With respect to the mechanical devices for adjustment of the air gaps V, construction of such devices not being described herein, reference is made to the assignee's Finnish patent application No. 83 3589, which corresponds to U.S. Pat. No. 4,675,487.

With respect to the electrotechnical background of the present invention, the following has been associated. When a variable magnetic field is provided in a material that conducts electricity, as is well known, eddy current and hysteresis losses are produced in the material, and the material is heated. The power (P) of the eddy currents depends on the intensity (B) of the magnetic field and on the frequency (f) of variation of the magnetic field as follows:

$$P \quad B^2 \cdot f^2 \tag{3}$$

The variable magnetic field produced on the roll 30 is closed or concentrated between the front face of the iron core and mantle of the roll 10, through the air gaps V. This magnetic field induces eddy currents in the surface layer of the roll mantle 10, said eddy currents generating heat due to the high resistance in the roll mantle 10. The distribution of the eddy currents induced in the mantle in the direction x of the radious of the roll, follows the law $$I_x = I_o e^{-x/\delta} \tag{4}$$

where $I_x$ is current density at the depth x taken from the mantle face 10', $I_o$ is current density on the face 10' of the mantle 10, and $\delta$ is depth of penetration. The depth of penetration has been defined as the depth at which the current density has been lowered to 1/e of the current density $I_o$. For depth of penetration, the follow expression has been obtained:

$$\delta = \frac{1}{2\pi} \sqrt{\frac{10^7 \rho}{f \mu}} \tag{5}$$

wherein $\rho$=specific resistance of the material, f=frequency of the magnetizing current, and $\mu$=relative permeability of the material.

This expression shown that with a higher frequency, depth of penetration is reduced. When steel is heated, both electric conductivity and permeability are reduced with a rising temperature.

In the present invention, heating capacities are used which are, as a rule, on the order of about 1 to 30 kW/m. As is well known, the smaller the air V, the larger the proportion of electric power passed to the apparatus through the winding 30 which is transferred into the roll mantle 10 to be heated.

In accordance with FIG. 6, the electric power feeding the induction coil 30 is taken from a 50 Hz three-phase network (3×380 V). By means of a rectifier 33, the AC current is converted to DC current which is, by means of an invertor based on power electronics and known in and of itself, converted to either constant-frequency or variable-frequency ($f_s$) AC current. Adjustment of positions of the component cores $20_1 \ldots 20_N$ in the iron core 20, can be carried out, e.g., by means of the automatic closed regulating system illustrated in FIG. 6. The adjusting motors are stepping motors 29 which receive their control signals $S_{1\text{-}N}$ from the regulating system 42. The regulating system is controlled by a detector device 41, which is, e.g., an apparatus for measurement of temperature, by means of which factual values of the surface temperatures $T_{01} \ldots T_{0k}$ of the roll are measured at several different points in the axial direction K—K of the roll 10. If the regulating system 42 includes a set-value unit, it is possible by means of this to set the temperature profile in the axial direction K—K of the roll 10, so that optimal detaching of the web W is obtained.

In FIG. 6, reference numeral 30' denotes terminals of coil 30 to which a voltage u is applied. Reference numeral 38 denotes a unit, e.g., a pump, from which cooling fluid $W_{in}$ conducted through tube 39 to coil 30, and to which cooling fluid returns through tube 39 as flow $W_{out}$. Coil 30 may then be made, e.g., of copper tubing, through which cooling fluid $W_{in}$–$W_{out}$ flows from pump 38 through tubes 39.

The output of an inverter 34 which changes direct current-power to alternating current power, is fed through a matching transformer 35 into an LC resonance circuit. In a manner known in and of itself, the transformer 35 has a primary circuit **35*a*, an iron core 35*b*, and a secondary circuit 35*c*. The secondary circuit has n pcs. of taps $45_1 \ldots 45_n$, which can be connected via a change-over switch 36 to the resonance circuit 37, by means of which the power is fed into the induction coil 30**. As is well known, the resonance frequency of an RLC circuit connected in series, can be calculated from the following formula:

$$f_r = \frac{1}{2\pi\sqrt{LC}} \tag{6}$$

where L represents inductance of the resonance circuit and C represents the capacitance thereof. In resonance, the current $I_r = U/R$, wherein R is the resistance of the circuit 37, and U is the terminal voltage thereof.

Efficiency of the transfer of heating capacity is optimal when the operation takes place at the resonance frequency $f_r$. However, it has been found that due to several reasons, it is not optimal to operate at the resonance frequency $f_r$ and/or simultaneously on both sides of the same. Rather, the frequency of operation is chosen within areas $f_{a1}$ to $f_{y1}$ above the resonance frequency $f_r$, or correspondingly within the area $f_{a2}$ to $f_{y2}$ below the resonance frequency $f_r$. These frequency ranges are preferably chosen within the scope of the present invention, as follows:

$$f_{a1} \text{ to } f_{y1} = \text{about } (1.01 \text{ to } 1.15) \times f_r, \text{ or } f_{a2} \text{ to } f_{y2} = \text{about } (0.85 \text{ to } 0.99) \times f_r.$$

According to FIG. 6, a series capacitor $C_s$ is used in the RLC circuit. The circuit 37 is tuned with basic tuning, so that transmission ratio of the transformer 35 is chosen by means of the switch 36, so that the resonance frequency $f_r$ calculated from formula (6) becomes correctly positioned in accordance with the principles given above.

FIG. 6 illustrates a parallel capacitor $C_r$ by way of broken lines. This parallel capacitor $C_r$ can be used instead of or along with the series capacitor $C_s$.

As is well-known, the resonance frequency $f_r$ in a parallel residence circuit, whose induction coil (L) has a resistance R and a capacitance C, is calculated as follows:

$$f_r = \frac{1}{2\pi\sqrt{LC}} \sqrt{1 - \frac{R^2C}{L}} \tag{7}$$

The above equation (7) includes a factor dependent upon the resistance R.

However, a series resonance circuit is, as a rule, preferable, especially in view of adjustment and control.

Within the scope of the present invention, the resonance frequency is generally chosen within the range of $f_r$=about 2–35 kHz.

Depending upon dimensioning of the coil cores 20 and on the air gap V between the roll 10 and the cores $20_N$, inductance of the resonance circuit is, e.g. with a roll 1 of a length of about 8 m., on the order of about 10–250 μH. For example, if L=60 μH and $f_r$=20 kHz, then the value of the capacitance of the capacitor becomes $C_s$=1.06 μF.

In order to maintain the efficiency of the power supply high and to eliminate any problems of instability, i.e., "risk of runaway", the operating frequency $f_s$ is arranged to be automatically adjusted in accordance with the impedance of the resonance circuit 37, so that the operating frequency $f_s$ remains near the resonance frequency $f_r$, yet at a safe distance therefrom, in view of the risk of runaway, i.e., within the areas $f_{y1}$–$f_{a1}$ or $f_{y2}$–$f_{a2}$.

The measurement of the impedance of the resonance circuit 37 may be based, e.g., on measurement of the current I passing in the circuit. This mode of measurement is illustrated in FIG. 6 by the block 46, from which the control signal d is controlled from the regulating unit 47, which alters the frequency $f_s$ of a frequency converter 34 on the basis of control signal bm(the invertor 34 may also comprise a function that converts the output current variable-frequency ($f_s$) to AC current).

A further mode of measurement of the impedance, which may be an alternative mode or which may be used in addition to the current measurement, is passing a control signal c from the block 42 from which information can be obtained on positions of the component cores $20_N$, i.e. on the air gap V, which substantially determines the impedance by acting upon the iinductance L. An alternative mode of adjustment is passing feedback signals from the stepping motors 29 into the block 47 and further so as to act upon the output frequency $f_s$ of the frequency convertor 34.

The mode of adjustment based on change in frequency described above, can be used either alone in adjusting the temperature profile of the roll 10, or in addition to and together with air-gap adjustments to improve accuracy and/or rapidity of adjustment.

In certain cases, by using the above mode of adjustment based on change in frequency, it is possible to completely omit mechanical regulating devices acting upon the air gap V. In this manner, it is possible to increase the rapidity of the regulating system, and, in certain cases, to improve accuracy of adjustment, even though it may be necessary in such a case to be satisfied with a somewhat lower efficiency of the power supply.

The preceding description of the present invention is merely exemplary, and is not intended to limit the scope thereof in any way. The various details of the present invention may vary within the scope of the inventive concepts set forth above, which have given for exemplary purposes only.

We claim:

1. Method for detaching a moist paper web from a roll, comprising the steps of detaching the web from said roll, adjusting temperature of a surface of said roll, whereby adhesion between said web and said roll surface is affected, and setting at least one of a detaching angle of said web off said roll and detaching tension of said web as a result of said temperature adjustment, comprising the additional steps of pre-selecting at least one of said detaching tension and detaching angle, then determining at least one of surface tension and viscosity of water in the web, then selecting desired temperature of said roll surface based upon at least one of said determined viscosity and surface tension, and then carrying out said temperature adjustment step, whereby at least one of said detaching tension and angle are set.

2. The method of claim 1, wherein said roll is a smooth-surfaced press roll in a press section in a paper machine.

3. The method of claim 2, wherein said smooth-surfaced press roll is a central roll about which a plurality of press nips are formed in the press section of the paper machine which is closed by the web always being supported on at least one of a roll and supporting fabric through said press section.

4. The method of claim 1, comprising the additional step of adjusting temperature profile along the surface of said roll over an axial direction thereof.

5. The method of claim 1, wherein said temperature of said roll surface is adjusted by inductively heating said roll surface from outside thereof without contact.

6. The method of claim 1, wherein said roll surface temperature is adjusted within the range of about 30° C.–150° C.

7. The method of claim 6, wherein said roll surface temperature is adjusted within the range of about 50°–100° C.

8. The method of claim 1, wherein said temperature is adjusted by circulating a heating medium inside a mantle of said roll.

9. The method of claim 8, wherein said heating medium is water or steam.

10. The method of claim 1, wherein said temperature is adjusted by applying heat from outside said roll and from a steam box or an infrared radiation heater.

11. The method of claim 3, comprising the additional steps of passing said web through a first double-felt nip, then passing said web through a second nip formed between said central roll and another press roll, prior to detaching said web from said central roll.

12. The method of claim 11, wherein said another press roll is a press-suction roll.

13. The method of claim 11, comprising the additional step of passing said web through a third press nip formed with said central roll, prior to detaching said web from said central roll.

14. The method of claim 1, wherein the web is detached as an open draw off said roll surface.

15. The method of claim 1, wherein the temperature of said roll surface is adjusted by at least one of the steps of (a) applying heat from outside said roll and from a steam box or an infrared radiation heater;

(b) circulating a heating medium inside a mantle of said roll; and (c) inductively heating said roll surface from outside thereof without contact.

16. The method of claim 15, wherein two of said three steps (a), (b) and (c) are applied.

17. The method of claim 16, wherein all three steps (a), (b), and (c) are applied.

18. The method of claim 14, wherein the web is unsupported by another fabric on a run of said roll between a final nip about said roll in a direction of web travel and a detaching point of the web off said roll surface.

19. The method of claim 18, wherein said run of said web about said roll surface between said final nip and said detaching point, is at least about 45°.

20. The method of claim 1, wherein at least one of said surface tension and viscosity is calculated according to the following two formulas:

$$\text{DETACHING TENSION} = \frac{\text{WEB ELONGATION WORK} + \text{WEB DETACHING WORK}}{1 - \text{COSINE OF DETACHING ANGLE}} (1 + \text{ELONGATION})(\text{MASS})(\text{VELOCITY})^2$$

$$\text{WEB DETACHING WORK} = 8.42 \left( \frac{\text{VISCOSITY} \times \text{VELOCITY}}{\text{VISCOSITY} \times \text{VELOCITY/SURFACE TENSION}} \right)^{0.95}$$

21. In a paper machine including a roll over a surface of which a moist paper web travels through at least one press nip formed in conjunction with said roll, a method for detaching the moist paper web from said roll, comprising the steps of detaching the web from said roll at a detaching point after a final one of said at least one nip in a direction of web travel, adjusting temperature of a surface of said roll, whereby adhesion between said web and said roll surface is affected, and setting at least one of a detaching angle of said web off said roll and detaching tension of said web as a result of said temperature adjustment, wherein said temperature of said roll surface is adjusted by inductively heating said roll surface from outside thereof without contact, and wherein said inductive heating is applied to said surface of said roll and web between said final press nip and said detaching point of the web off said roll surface.

22. In a paper machine including a roll over a surface of which a moist paper web travels through at least one press nip formed in conjunction with said roll, a method for detaching the moist paper web from said roll, comprising the steps of detaching the web from said roll at a detaching point after a final one of said at least one nip in a direction of web travel, adjusting temperature of a surface of said roll, whereby adhesion between said web and said roll surface is affected, and setting at least one of a detaching angle of said web off said roll and detaching tension of said web as a result of said temperature adjustment, wherein said roll is a smooth-surfaced press roll in a press section in the paper machine, wherein said smooth-surfaced press roll is a central roll about which a plurality of press nips are formed in the press section of the paper machine which is closed by the web always being supported on at least one of a roll and supporting fabric through said press section, and comprising the additional steps of passing said web through a first double-felt nip, then passing said web through a second nip formed between said central roll and another press roll, and passing said web through a third press nip formed with said central roll and which is said final nip prior to said detaching point of said web from said central roll, and wherein said temperature of said roll surface is adjusted by inductively heating said roll surface from outside thereof without contact, after said third and final press nip and prior to said detaching point of the web from said central roll.

23. Method for detaching a moist paper web from a roll, comprising the steps of detaching the web from said roll, adjusting temperature of a surface of said roll, whereby adhesion between said web and said roll surface is affected; and setting at least one of a detaching angle of said web off said roll and detaching tension of said web as a result of said temperature adjustment, wherein at least one of said detaching angle and detaching tension is set according to the following two formulas:

$$\text{DETACHING TENSION} = \frac{\text{WEB ELONGATION WORK} + \text{WEB DETACHING WORK}}{1 - \text{COSINE OF SAID DETACHING ANGLE}} (1 + \text{ELONGATION})(\text{MASS})(\text{VELOCITY})^2$$

$$\text{WEB DETACHING WORK} = 8.42 \frac{(\text{VISCOSITY} \times \text{VELOCITY})}{(\text{VISCOSITY} \times \text{VELOCITY/SURFACE TENSION})} 0.95$$

wherein at least one of said viscosity, surface tension, and web detaching work is dependent on the temperature of said roll surface.

* * * * *